US010681942B2

(12) United States Patent
Thompson

(10) Patent No.: US 10,681,942 B2
(45) Date of Patent: Jun. 16, 2020

(54) RECONFIGURABLE POST-SURGERY BRASSIERE

(71) Applicant: Elizabeth Chabner Thompson, Scarsdale, NY (US)

(72) Inventor: Elizabeth Chabner Thompson, Scarsdale, NY (US)

( * ) Notice: Subject to any disclaimer, the term of this patent is extended or adjusted under 35 U.S.C. 154(b) by 0 days.

(21) Appl. No.: 16/129,301

(22) Filed: Sep. 12, 2018

(65) Prior Publication Data

US 2020/0077718 A1 Mar. 12, 2020

(51) Int. Cl.

| | |
|---|---|
| ***A41C 3/00*** | (2006.01) |
| ***A41D 13/12*** | (2006.01) |
| *A41C 3/02* | (2006.01) |
| *A41C 3/10* | (2006.01) |

(52) U.S. Cl.

CPC ..... *A41C 3/0064* (2013.01); *A41D 13/1281* (2013.01); *A41C 3/02* (2013.01); *A41C 3/10* (2013.01)

(58) Field of Classification Search

CPC .... A41C 3/0007; A41C 3/0028; A41C 3/0064
USPC ..... 450/7, 89, 86, 36, 54–58; 2/104, 106, 2/114, 110, 109, 69, 67, 105
See application file for complete search history.

(56) References Cited

U.S. PATENT DOCUMENTS

| | | | | |
|---|---|---|---|---|
| 5,429,593 | A | 7/1995 | Matory | |
| 6,032,289 | A | 3/2000 | Villapiano | |
| 6,055,668 | A | 5/2000 | Gros et al. | |
| 6,390,885 | B1 * | 5/2002 | Brooks | A41C 3/0064 450/1 |
| 6,574,800 | B1 * | 6/2003 | Leger | A41D 13/1245 2/114 |
| 9,545,124 | B1 * | 1/2017 | Thompson | A41C 3/0064 |
| 2005/0010273 | A1 * | 1/2005 | Walker | A61B 17/3415 607/105 |
| 2006/0085890 | A1 * | 4/2006 | Beuk | A41D 13/1281 2/114 |
| 2006/0173427 | A1 * | 8/2006 | Urbina | A41C 3/0064 604/327 |
| 2008/0282441 | A1 * | 11/2008 | Green | A41D 13/1245 2/69 |
| 2011/0041231 | A1 | 2/2011 | Behrens et al. | |
| 2018/0332905 | A1 * | 11/2018 | Stephens | A41C 3/0064 |

FOREIGN PATENT DOCUMENTS

| | | |
|---|---|---|
| WO | 2015/195170 A | 12/2015 |
| WO | 2018/213681 A | 11/2018 |

OTHER PUBLICATIONS

"Elizabeth Pink Surgical Bra", https://mastheadpink.com/bras/, Dec. 19, 2018.

Authorized Officer Antonia Teixeira, International Search Report and Written Opinion dated Oct. 25, 2019 issued in International Application No. PCT/US2019/050815.

* cited by examiner

*Primary Examiner* — Gloria M Hale

(74) *Attorney, Agent, or Firm* — Kaplan Breyer Schwarz, LLP

(57) ABSTRACT

A post-surgery brassiere comprises at least two catches for engaging two ring assemblies that detachably couple to collection bulbs and detachably couple to the two catches.

27 Claims, 3 Drawing Sheets

Prior
Art

Prior
Art

RECONFIGURABLE POST-SURGERY BRASSIERE

STATEMENT OF RELATED CASES

This case is related to U.S. Pat. No. 9,545,124, issued Jan. 17, 2017.

FIELD OF THE INVENTION

The present invention relates to brassieres in general and, more particularly, to a brassiere for use by women immediately following breast surgery.

BACKGROUND OF THE INVENTION

In 2018, an estimated 266,000 new cases of invasive breast cancer and 64,000 cases of in situ breast cancer in women, and 2550 new cases in men, are expected to be diagnosed in the United States. The majority of these individuals will seek medical treatment for their disease. Women diagnosed with early stage breast cancer have several options for treatment. The surgical options include mastectomy, with or without reconstruction, or lumpectomy followed by radiation therapy and possibly chemotherapy. MA data from 2000-2007 indicates that approximately 30% to 40% of women undergo mastectomy with or without reconstruction. Most male patients undergo mastectomy alone.

The majority of patients undergoing mastectomy will have a simple, skin-sparing mastectomy, whereby the breast tissue is removed and underlying muscle and overlying skin are spared. The extent and type of surgical procedure used depends upon the staging of the tumor, patient preferences, and the physician's skills for reconstruction. Axillary lymph node sampling via sentinal node detection and removal is standard procedure; however, axillary lymph node dissection and removal are still indicated when gross disease is present.

Removing breast tissue (with or without immediate reconstruction) and lymph nodes leads to the accumulation of serous fluid in the chest region and local tissues. During the recovery process, the body slowly develops collateral drainage that removes this excess fluid from the tissues. Surgical drains are implanted to assist in serous/serosanguinous fluid removal. The drains reduce the incidence of post-operative complications and morbidity from infection, hematoma formation, and skin-flap compromise.

One or more drains (e.g., Jackson-Pratt ("JP") drain, etc.) are surgically implanted near each operative site to drain serous lymphatic fluid as well as some blood that accumulates after the mastectomy or breast surgery. The drains include about a meter of flexible tubing that transports fluid from the surgical site to a bulbous reservoir ("collection bulb"). A perforated collection tube lies under the skin; most of the tubing and the collection bulb are extracorporeal.

The tubing is sutured to the skin at its point of exit from the body. This point of exit varies for each mastectomy case; the surgeon chooses the exit site for the drain tubing at the time of mastectomy based on individual body habitus and the type of surgical reconstruction used. The tubing's exit location can vary from right side to left side of the body, but is generally located to the lateral side of the mastectomy site near the axillary region. The drains remain in place collecting fluid for one week to as long as a month or more. The patient is responsible for daily maintenance of the drains, which includes emptying the collection bulb approximately 4 times daily. Once serous drainage diminishes to a point at which the body can reabsorb the fluid, the drains are removed.

Although the drains serve an important and necessary function, they are a source of discomfort for many patients. During daily activities, the weight of the collection bulb and the presence of dangling tubing often results in pain-provoking tension at the exit point due to the sutures. A variety of post-operative garments have been proposed to address this and other issues, including, for example: U.S. Pat. Nos. 5,429,593, 6,032,289, 6,055,668, and U.S. Publ. Pat. Appls. 2006/0173427 and 2011/0041231.

The garments disclosed in the aforementioned patent documents are intended to be suitable for both men and women; in some cases the garment must be modified for anatomical differences, in other cases not. For example, the garments disclosed in U.S. Pat. No. 5,429,593 and U.S. Publ. Pat. Appl. 2006/0173427 are unsuitable for use as a brassiere (and hence provide limited utility for a female patient). The garment disclosed in U.S. Pat. No. 6,032,289 is supposedly capable of being modified into the form of a brassiere. U.S. Publ. Pat. Appl. 2011/0041231 discloses a smock-like garment that can have a bra-like attachment fitted thereto. U.S. Pat. No. 6,055,668 discloses a bra-like garment that can be made with cups (for women) or without cups (for men). Designed to be useful for both men and women, the aforementioned garments are a poor substitute for a brassiere.

Unlike the references discussed above, U.S. Pat. No. 6,390,885 discloses a garment that is intended exclusively for women—a surgical-recovery brassiere. The brassiere includes several drain tube apertures that are sized to permit the flexible tubing of a drain to pass through the side panel. A storage pouch is disposed at the lower edge of the brassiere to receive the collection bulbs of the drains. The pouch includes divided pockets and has an elastic top entry so that the collection bulbs can be readily accessed for drainage. This garment does not take into account changes in surgical procedures during the last decade, such as variation in drain exit points.

Over the last ten years there have been a number of developments in breast surgery; for example, novel surgical techniques, the use of human acellular dermal matrix, direct-to-implant reconstruction or delayed two-stage reconstruction involving expanders and implant exchange. Many of the post-surgical garments (e.g., brassieres, etc.) discussed above are poorly adapted to accommodate these developments. In particular, and among other drawbacks, a number of prior-art, post-surgery brassieres function as complete compressive wraps. With the advent of, for example, direct-to-implant reconstruction, such indiscriminately applied compression is undesirable.

Applicant has developed a post-surgery brassiere that addresses some of the aforementioned issues. It is commercially available at https://mastheadpink.com/bras/ as the ELIZABETH PINK SURGICAL BRA® brand post-surgical brassiere. FIG. 1 depicts, as prior-art post-surgery bra 100, the aforementioned ELIZABETH PINK SURGICAL BRA®.

Bra 100 includes cups 102A and 102B, shoulder straps 104A and 104B, and back band 108. Bra 100 includes several release points, including medial closure 110, superior closures 106A and 106B, which are situated along respective shoulder straps 104A and 104B, and side closures 116, one of which is disposed between backband 108 and cup 102A and the other between the backband and cup 102B. The release points are implemented as hook-and loop fastener 112 (i.e., VELCRO™), which is shown for closure 110. Markings 118 serve as a scale/index for repeated, consistent positioning of the closure.

Side closures 116 form apertures 114. The apertures are positioned so that when the brassiere is in use, each aperture aligns with the side of the patient underneath each axilla (i.e., arm pit). Apertures 114 enable the extracorporeal flexible tubing of a drain (e.g., JP drain, etc.) to pass through the bra. The apertures are embodied as "plackets," as opposed a hole through the side band, so that a user can don or remove the bra without removing the drain's collection bulb. To the extent that a bra includes a hole (as opposed to a placket), which is sized to permit passage of a collection bulb for a specific type of drain, it might be undersized to permit the passage of other bulbs from other drains. In such a case, this will require removing the collection bulb from the drain tube to remove the bra.

Base band 120 comprises an elastic material that is attached to the bottom edge of the cups 102A and 102B and back band 108. By virtue of its elasticity, base band 120 ensures that the bottom of the bra remains tight to the body when in use.

To support the extracorporeal portions of a JP drain, bra 100 includes two loops 122 of material, such as ribbon, etc., one of which is sewn to and hangs from base band 120 below each cup 102A and 102B. One openable retaining ring 124 couples to each loop 122. In the illustrative embodiment, retaining rings 124 comprises plastic. The retaining ring can be opened and closed to support the collection bulb and associated tubing of a drain.

FIG. 2 depicts the extracorporeal portions of a JP drain extending through one of apertures 114 of bra 100. In particular, drain tube 232, the hidden end of which extends into the patient's surgical site, couples to collection bulb 234 of the JP drain. The collection bulb collects excess lymphatic fluid that is withdrawn from the body via tube 232. As depicted, when bra 100 is in use, loop 236 of collection bulb 234 couples to retaining ring 124. As previously discussed, to couple retaining ring 124 to loop 236, the ring is opened, the loop 236 is positioned on the opened ring, and then the ring is closed.

This arrangement ensures that collection bulb 234 is supported and further that it hangs below the heart, as is required for best fluid drainage. Also, because the collection bulb is attached to the brassiere near its bottom edge, and because the drain tubing remains hidden underneath the patient's blouse, it is very unlikely that the drain tubing could snag on anything that would otherwise cause tension/tugging on the sutured skin at the insertion site. Furthermore, the drain bulb is not forced into an ill-fitting pocket, as in a number of prior-art post-surgery garments. As a consequence, pain and discomfort are minimized and accidental dislodgement of the tubing is prevented.

Applicant has also received U.S. Pat. No. 9,545,124 for a post-surgical brassiere specifically adapted for immobilizing the tubes of an after-loaded catheter/brachytherapy device.

In medicine as in many other fields, the state-of-the-art is advancing with increasing rapidity. This means a steady stream of new medical procedures and concomitant changes to the standard-of-care. In some cases, by the time a new medical device is approved, it's nearly out-of-date. Also, hospital physicians will often use what they have on hand to address a problem, particularly if an application-specific device is not available. For example, although bra 100 was designed with a focus on recovery from breast surgery, it has been used in hospitals to decrease patient morbidity and improve patient comfort in a variety of other applications in which it is necessary to drain fluids from patients. Typical examples include post cardiac and thoracic surgery. But because it was designed with a single application in mind, bra 100 lacks a certain flexibility that would make it that much for suitable for such other applications.

Consequently, it is desirable that new medical devices be designed, to the extent possible, to be broadly applicable and adaptable.

SUMMARY OF THE INVENTION

The present invention provides a post-surgery brassiere ("bra") with increased utility as compared to the prior art. In addition to finding application, after surgery, to lumpectomy, direct-to-implant reconstruction, or expander/delayed reconstruction, the bra can also be used in support of a patient's recovery from any number of procedures that will require the drainage of fluid from a woman's torso.

In accordance with the present teachings, a reconfigurable post-surgery brassiere includes, along the base band thereof, on both the left and right sides of the midline of the front of the bra, at least one, and preferably at least two eyelets. The eyelets provide a way to detachably couple drain-bulb support rings to the bra.

In some embodiments, prior-art bras, such as the ELIZABETH PINK SURGICAL BRA® and post-surgery bra disclosed in U.S. Pat. No. 9,545,124, are modified for use consistent herewith. In particular, the permanently attached, bulb-supporting loop/ring assemblies are replaced by the aforementioned eyelets and detachable loop/ring assemblies that include a hook for attachment to the eyelets.

In some embodiments, a post-surgery bra in accordance with the present teaching is supplied with two hook/loop/ring assemblies. If a patient has a need for only one such loop and ring, the second hook/loop/ring assembly is removed from the bra. Or, if a patient needs to support two bulbs on one side, then both of the hook/loop/ring assemblies are coupled to the two hooks on the appropriate side of the bra. It is notable that for prior-art bra 100, if two bulbs need to be supported on one side of the body, it is accomplished by coupling the two bulbs to the one ring. This is not ideal, however, since this limits the ability of the patient to position the bulbs under clothing, thereby increasing the difficulty of hiding the bulbs and increasing the possibility of drain lines becoming entangled.

Also, as a consequence of a series of surgeries, it might be the case that drain bulbs must be supported on different sides of the bra's midline at different times. In bras in accordance with the present invention, this can readily be accomplished by simply moving the hook/loop/ring assemblies to one side or the other, as appropriate.

Furthermore, in some cases, based on the particular placement of a drain in a patient, it will be most convenient or desirable for the drain tube to pass through the bra between the breast cups, as facilitated by post-surgery bras having a medial closure (see, e.g., FIG. 1, medial closure 110). In embodiments of the invention in which multiple eyelets are present on each side of the midline of the bra, it is likely that at least one such eyelet will be in a desirable location for connecting to a hook/loop/ring assembly that will support the drain bulb of such a medially exiting drain line. This is not the case for prior-art post-surgical bras such as the ELIZABETH PINK SURGICAL BRA® or the post-surgery bra disclosed in U.S. Pat. No. 9,545,124, wherein the one fixed loop/ring assembly on each side of the midline is sited in a relatively lateral location on the bra.

In some embodiments, the bra is customized for each patient in the sense that in addition to being appropriately sized, it is supplied with the requisite number of hook/loop/ring assemblies. In some other embodiments, the bra is provided with the maximum number of hook/loop/ring assemblies that the bra is capable of accommodating (e.g., 2, 4, 6, etc.).

In some embodiments, a post-surgery brassiere comprises:

two breast cups;

a back band that couples to the two breast cups;

a first shoulder strap and a second shoulder strap, wherein a first end of each shoulder strap is coupled to a respective breast cup and a second end of each shoulder strap couples to the back band;

an aperture disposed along a side of the post-surgery brassiere and sited so that when the brassiere is in use by a wearer, the aperture aligns with a respective axilla of the wearer; and at least two catches, with a minimum of one catch disposed proximal to a bottom of each breast cup, and wherein each catch is capable of coupling a drain bulb to the post-surgery brassiere.

In some embodiments, a post-surgery brassiere comprises:

two breast cups;

two apertures, one disposed along each side of the post-surgery brassiere and sited so that when the brassiere is in use by a wearer, each aperture aligns with a respective axilla of the wearer;

at least two catches, with a minimum of one catch disposed proximal to a bottom of each breast cup; and at least two ring assemblies for coupling to drain bulbs, wherein each ring assembly is coupleable to a catch, wherein, in use of the post-surgery brassiere, none, one, or two of the ring assemblies can be coupled to a respective none, one or two of the catches.

In some embodiments, the invention provides:

A kit comprising:

a post-surgery brassiere having:

two breast cups;

an aperture disposed along a side of the post-surgery brassiere and sited so that when the brassiere is in use by a wearer, the aperture aligns with a respective axilla of the wearer; and at least two catches, with a minimum of one catch disposed proximal to a bottom of each breast cup; and at least two ring assemblies for coupling to drain bulbs, wherein each ring assembly is detachably coupleable to a respective one of the catches.

DETAILED DESCRIPTION

Figure 3:
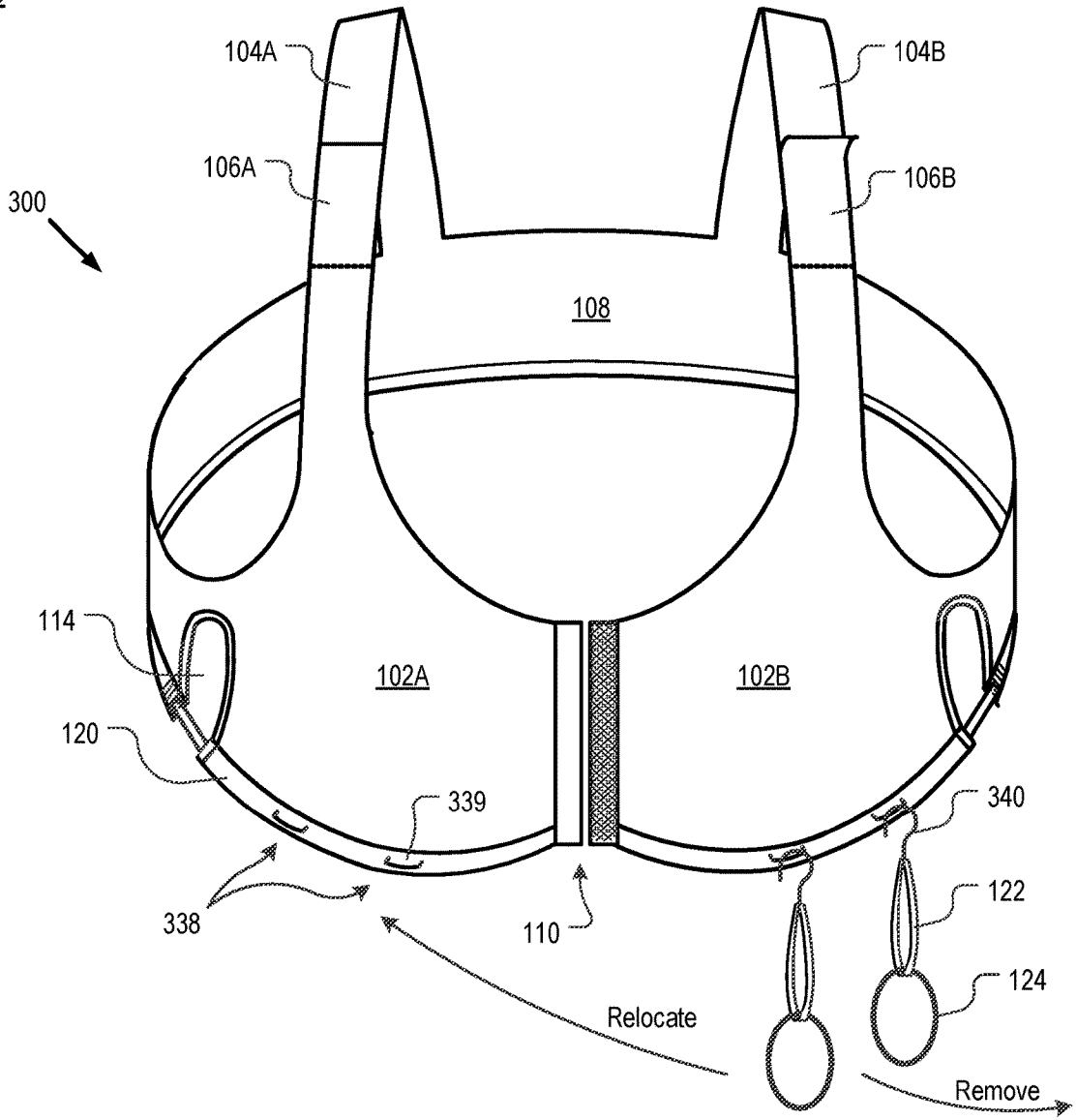
FIG. 3 depicts reconfigurable post-surgery brassiere 300 in accordance with the illustrative embodiment of the present invention.

FIG. 3 depicts post-surgery brassiere ("bra") 300. In the illustrative embodiment, bra 300 includes cups 102A and 102B, shoulder straps 104A and 104B, back band 108, and base band 120, arranged as shown.

In the illustrative embodiment, brassiere 300 comprises five release points: medial closure 110 (disposed between cups 102A and 102B), superior closures 106A and 106B (one along each of respective shoulder straps 104A and 104B), and side closures 116, one of which is disposed between backband 108 and cup 102A and the other between the backband and cup 102B. In the illustrative embodiment, all such closures comprise paired strips of hook and loop fastener, such as Velcro® brand, available from Velcro Co. of Manchester, N.H. Alternatively, the closures can comprise "hooks" and "hook-compatible fabric." Other types of closures can suitably be used (e.g., "hook-and-eyelet," etc.).

Cups 102A and 102B and back band 108 comprise a compressive fabric, such as, without limitation, Lycra® brand spandex fiber or Tencel® brand fiber. In some embodiments, the compressive fabric includes an anti-stain treatment.

Apertures 114 are formed at the site of side closures 116. The aperture is sited so that when the brassiere is in use, each aperture aligns with the side of the patient underneath the respective axilla (i.e., arm pit). Apertures 114 enables the flexible tubing of a drain (e.g., JP drain, etc.) to pass through bra 300.

As in applicant's aforementioned ELIZABETH PINK SURGICAL BRAS and the post-surgery bra disclosed in U.S. Pat. No. 9,545,124, apertures 114 are implemented as "plackets." Using plackets, as opposed a hole through the bra, enables a user to don or remove bra 300 without having to remove the drain's collection bulb. Also, if a hole (rather than a placket) were sized to permit passage of a collection bulb for a specific type of drain, it might be undersized to permit the passage of other bulbs from other types of drains. This would require that the user remove the collection bulb of the drain to remove the bra.

Band 120 comprises an elastic material that is attached to the bottom edge of the cups 102A and 102B and back band 108. By virtue of its elasticity, band 120 ensures that the bottom of the bra remains tight to the body when in use.

With the exception of the features discussed below, the structure of bra 300 is essentially the same as that of the ELIZABETH PINK SURGICAL BRA®.

Eyelets 338 are disposed on bra 300 proximal to the bottom of each cup. In the illustrative embodiment, four eyelets are attached to base band 120, two on the left and two on the right of the midline of the front of bra 300. In some other embodiments, one eyelet 338 is disposed on each side of the midline; in yet some further embodiments, three or more eyelets 338 are disposed on each side of the midline.

In the illustrative embodiment, each eyelet 338 projects outward from base band 120, forming a region or gap 339 defined between a portion of base band and the eyelet. Region 339 is used to snare hook 340. Since, in the illustrative embodiment, hook 340 is attached to loop 122, and the loop couples to ring 124, the ring can be removably coupled to bra 300. For use in this disclosure and the appended claims, the phrase "removably coupled" or "detachably coupled" (as well as inflected forms) means that something can be repeatedly coupled to and decoupled from something else. So, by virtue of this arrangement, rings 124 can be removably coupled to any eyelet 338, enabling them to be readily positioned where needed. Or one or more of rings 124 can be removed from eyelets 338 (and hence bra 300). A variety of arrangements of rings on eyelets are therefore possible.

For, example, if there are two eyelets 338 on each side of the midline, one close to the midline ("medial"), and one further from the midline ("lateral"), and four rings 124 are available, then the following sixteen arrangements are possible ("x" indicates that a ring is coupled to an eyelet):

TABLE 1

Possible Arrangements of Bulb-Supporting Rings

| Left Side | | Right Side | |
|---|---|---|---|
| medial | lateral | medial | lateral |
| — | — | — | — |
| x | — | — | — |
| — | x | — | — |
| x | x | — | — |
| — | — | x | — |
| — | — | — | x |
| — | — | x | x |
| x | — | x | — |
| x | — | — | x |
| x | — | x | x |
| — | x | x | — |
| — | x | — | x |
| — | x | x | x |
| x | x | x | — |
| x | x | — | x |
| x | x | x | x |

As will be appreciated by perusing Table 1, eyelets 338 and removably coupleable rings 124 imbue bra 300 with a far improved ability, relative to the prior art, to provide an ideal location for situating a collection bulb.

Figure 1:
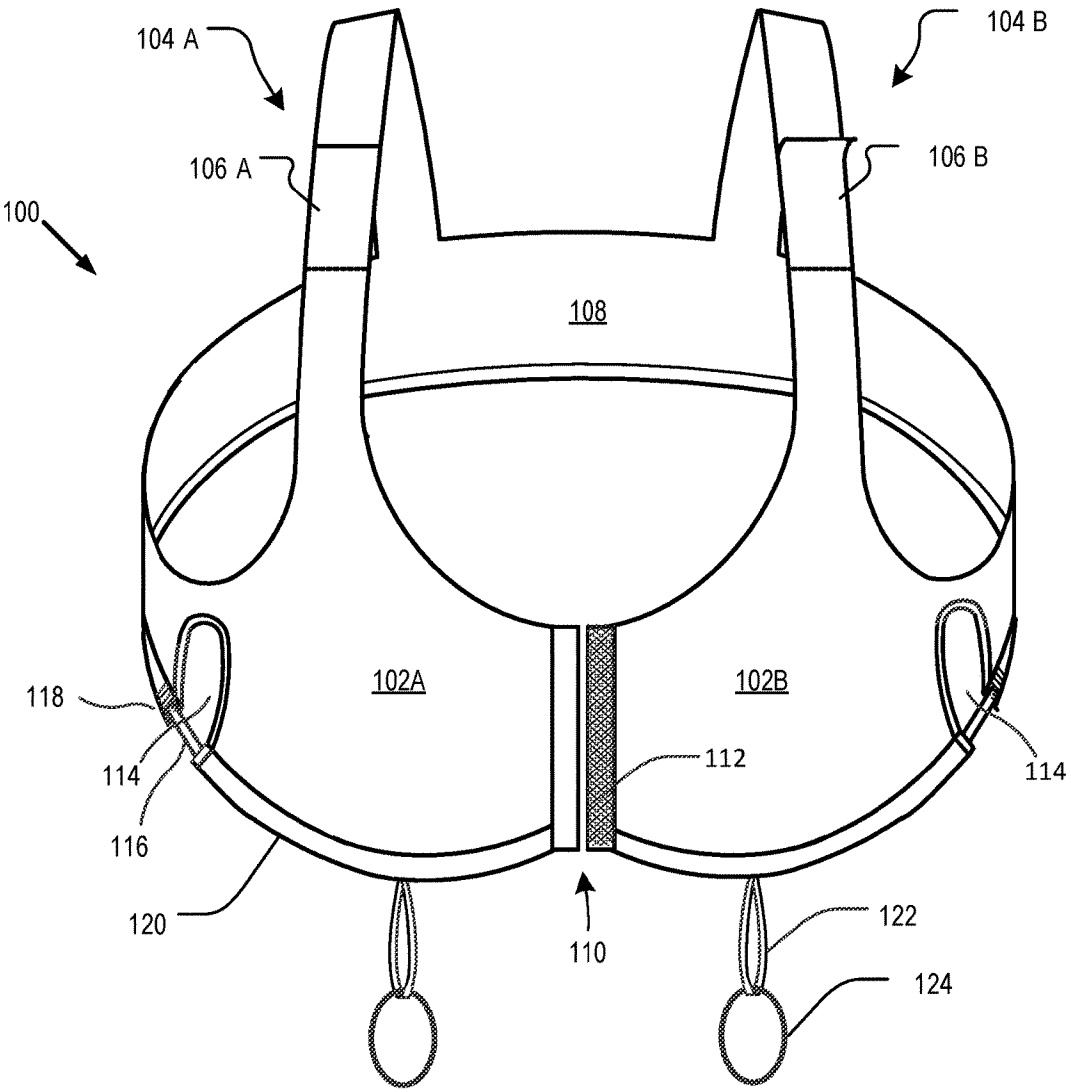
FIG. 1 depicts a front view of prior-art post-surgery brassiere 100.
Figure 2:
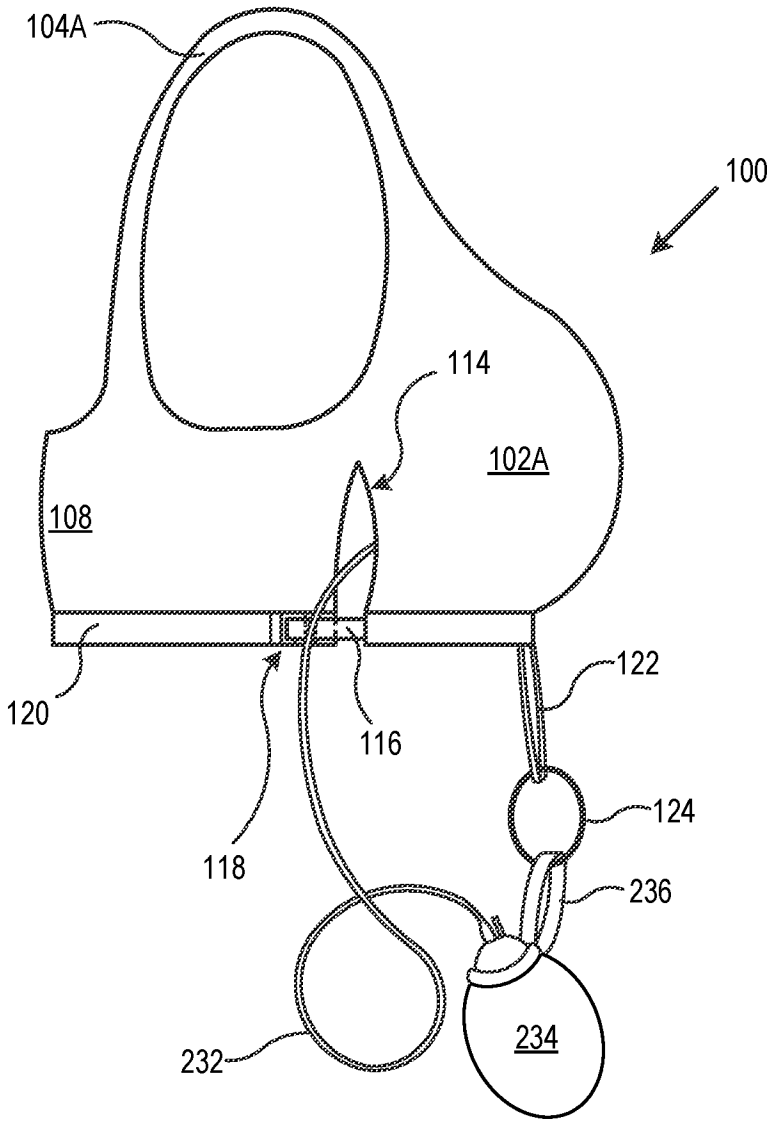
FIG. 2 depicts a side view of prior-art post-surgery brassiere 100, wherein the bra is supporting the bulb of a JP drain.

In the illustrative embodiment, hook 340 is attached to loop 122; it will be appreciated, however, that other structural arrangements are possible. For example, in some embodiments, hook 340 can be directly attached to ring 124. In yet some further embodiments, hook 340 is not used; rather, ring 124 couples directly to eyelet 338. As used in this disclosure and the appended claims, the phrase "ring assembly" refers to either ring 124 alone, ring 124 and hook 340, or ring 124, loop 122, and hook 340. In some alternative embodiments, the bulb of the drain may be directly coupled to eyelets 338. For example, a safety pin can be pinned to loop 236 (see FIG. 2) of collection bulb 234 and to eyelet 338.

It will be appreciated that other arrangements by which a collection-bulb supporting element (such as ring 124) is detachably coupled to bra 300 may suitably be used. As used in this disclosure and the appended claims, the term "catch" refers to a feature on the bra (e.g., eyelet 338, etc.) that is used to couple the collection bulb to bra 300. As used in this disclosure and the appended claims, reference to "coupling a/the collection bulb to the post-surgery brassiere" means that the collection bulb itself can be detachably coupled to the eyelets (i.e., directly), or that the bulb can be detachably coupled via other elements, such as the ring, and/or loop, and/or hook, etc. (i.e., indirectly).

It is preferable not to use hook-and-loop material as the catch (particularly on the "loop" or "ring"), since it can irritate a user's skin. Also, it is important that the catch is located such that the bulb of the drain hangs below the patient's heart, thereby promoting drainage of fluids.

The post-surgery brassiere disclosed in U.S. Pat. No. 9,545,124 can be modified to be consistent with the present teachings. That is, rather than permanently attaching a loop of ribbon to the base band of the bra disclosed therein, eyelets 338 are attached to the bra as disclosed herein.

Embodiments of the post-surgery brassiere disclosed herein can alternatively be considered to be a "kit," the kit including the post-surgery brassiere and some number of ring assemblies.

It is to be understood that the disclosure teaches just one example of the illustrative embodiment and that many variations of the invention can easily be devised by those skilled in the art after reading this disclosure and that the scope of the present invention is to be determined by the following claims.

For example, in some embodiments, a post-surgery brassiere in accordance with the present teachings can include side panels as well as a back band. It will be appreciate that in such embodiments, a portion of back band 108 is simply replaced by such side panels, which would be disposed between the back band and the cups. In embodiments in which side panels are present, aperture 114 can be disposed in the side panels, as opposed to being in the back band. What is of more importance is that when the brassiere is in use, the apertures are positioned under each axilla of the wearer so that the aperture aligns with the insertion point (in the wearer's body) of the drain tubing.

It is to be understood that many variations of the invention can easily be devised by those skilled in the art after reading this disclosure, and that the scope of the present invention is to be determined by the following claims.

What is claimed is:

1. A post-surgery brassiere comprising:

two breast cups;

a back band that couples to the two breast cups;

a first shoulder strap and a second shoulder strap, wherein a first end of each shoulder strap is coupled to a respective breast cup and a second end of each shoulder strap couples to the back band;

an aperture disposed along a side of the post-surgery brassiere and sited so that when the brassiere is in use by a wearer, the aperture aligns with a respective axilla of the wearer;

at least two catches, with a minimum of one catch disposed proximal to a bottom of each breast cup; and at least two ring assemblies that detachably couple to the at least two catches, wherein each catch, via the at least two ring assemblies, is capable of coupling a collection bulb to the post-surgery brassiere.

2. The post-surgery brassiere of claim 1 wherein each ring assembly comprises a hook, a loop, and a ring, wherein the ring is detachably coupled to the loop, and the hook is attached to the loop, and wherein the at least two catches are each dimensioned and arranged to receive each hook, one hook to one catch.

3. The post-surgery brassiere of claim 1 further comprising a base band attached to and disposed below the two breast cups, wherein the two catches are attached to the base band.

4. The post-surgery brassiere of claim 1 wherein each catch comprises an eyelet.

5. The post-surgery brassiere of claim 1 wherein the post-surgery brassiere has four catches, wherein a first two of the four catches are disposed to the left of a midline of the brassiere proximal to a bottom of a respective breast cup, and a second two of the four catches are disposed to the right of the midline of the brassiere proximal to a bottom of the respective breast cup.

6. The post-surgery brassiere of claim 1 wherein the aperture comprises a placket.

7. The post-surgery brassiere of claim 1 wherein the post-surgery brassiere has two apertures, each aperture disposed along a respective side of the post-surgery brassiere and sited so that when the brassiere is in use by a wearer, each aperture aligns with a respective axilla of the wearer.

8. The post-surgery brassiere of claim 7 wherein at least one of the apertures comprises a placket.

9. A post-surgery brassiere comprising:

two breast cups;

two apertures, one disposed along each side of the post-surgery brassiere and sited so that when the brassiere is in use by a wearer, each aperture aligns with a respective axilla of the wearer;

at least two catches, with a minimum of one catch disposed proximal to a bottom of each breast cup; and at least two ring assemblies for coupling to collection bulbs, wherein each ring assembly is coupleable to a catch, wherein, in use of the post-surgery brassiere, none, one, or two of the ring assemblies can be coupled to a respective none, one or two of the catches.

10. The post-surgery brassiere of claim 9 wherein the post-surgery brassiere has four catches, wherein a first two of the four catches are disposed to the left of a midline of the brassiere proximal to a bottom of one of the breast cups, and a second two of the four catches are disposed to the right of the midline of the brassiere proximal to a bottom of the other of the breast cups.

11. The post-surgery brassiere of claim 10 wherein the post-surgery brassiere has four ring assemblies, wherein, in use of the post-surgery brassiere, none of the ring assemblies, or any one or more of the four ring assemblies can be detachably coupled to a respective number of catches.

12. The post-surgery brassiere of claim 9 wherein each ring assembly comprises a hook, a loop, and a ring, wherein the ring is detachably coupled to the loop, and the hook is attached to the loop, and each of the at least two catches are dimensioned and arranged to receive, one each, the hook of each ring assembly.

13. A kit comprising:

a post-surgery brassiere having:

two breast cups;

an aperture disposed along a side of the post-surgery brassiere and sited so that when the brassiere is in use by a wearer, the aperture aligns with a respective axilla of the wearer; and at least two catches, with a minimum of one catch disposed proximal to a bottom of each breast cup; and at least two ring assemblies for coupling to collection bulbs, wherein each ring assembly is detachably coupleable to one of the catches.

14. The kit of claim 13 wherein the post-surgery brassiere has four catches, wherein a first two of the four catches are disposed to the left of a midline of the brassiere proximal to a bottom of one of the breast cups, and a second two of the four catches are disposed to the right of the midline of the brassiere proximal to a bottom of the other of the breast cups.

15. The kit of claim 14 wherein the post-surgery brassiere has four ring assemblies for coupling to drain bulbs, wherein each ring assembly is detachably coupleable to one of the catches.

16. A post-surgery brassiere comprising:

two breast cups;

an aperture disposed along a side of the post-surgery brassiere and sited so that when the brassiere is in use by a wearer, the aperture aligns with a respective axilla of the wearer; and at least two eyelets, with a minimum of one eyelet disposed proximal to a bottom of each breast cup, and wherein each eyelet is capable of coupling a collection bulb to the post-surgery brassiere.

17. The post-surgery brassiere of claim 16 further comprising at least two ring assemblies that detachably couple to the at least two eyelets.

18. The post-surgery brassiere of claim 17 wherein each ring assembly comprises a hook, a loop, and a ring, wherein the ring is detachably coupled to the loop, and the hook is attached to the loop, and wherein the at least two eyelets are each dimensioned and arranged to receive each hook, one hook to one catch.

19. The post-surgery brassiere of claim 16 further comprising a base band attached to and disposed below the two breast cups, wherein the two eyelets are attached to the base band.

20. The post-surgery brassiere of claim 16 wherein the post-surgery brassiere has two catches in addition to the two eyelets, wherein one of the eyelets and one of the catches are disposed to the left of a midline of the brassiere proximal to a bottom of a respective breast cup, and a second of the eyelets and a second of the catches are disposed to the right of the midline of the brassiere proximal to a bottom of the respective breast cup.

21. The post-surgery brassiere of claim 16 wherein the aperture comprises a placket.

22. A post-surgery brassiere comprising:

two breast cups;

an aperture disposed along a side of the post-surgery brassiere and sited so that when the brassiere is in use by a wearer, the aperture aligns with a respective axilla of the wearer, wherein the aperture is a placket; and at least two catches, with a minimum of one catch disposed proximal to a bottom of each breast cup, and wherein each catch is capable of coupling a collection bulb to the post-surgery brassiere.

23. The post-surgery brassiere of claim 22 further comprising at least two ring assemblies that detachably couple to the at least two catches.

24. The post-surgery brassiere of claim 23 wherein each ring assembly comprises a hook, a loop, and a ring, wherein the ring is detachably coupled to the loop, and the hook is attached to the loop, and wherein the at least two catches are each dimensioned and arranged to receive each hook, one hook to one catch.

25. The post-surgery brassiere of claim 22 further comprising a base band attached to and disposed below the two breast cups, wherein the two catches are attached to the base band.

26. The post-surgery brassiere of claim 22 wherein each catch comprise an eyelet.

27. The post-surgery brassiere of claim 22 wherein the post-surgery brassiere has four catches, wherein a first two of the four catches are disposed to the left of a midline of the brassiere proximal to a bottom of a respective breast cup, and a second two of the four catches are disposed to the right of the midline of the brassiere proximal to a bottom of the respective breast cup.

* * * * *